United States Patent [19]

Lewis

[11] 4,363,400

[45] Dec. 14, 1982

[54] DISPLAY CARTON WITH INTERNAL SPACER

[75] Inventor: Phillip W. Lewis, Greensboro, N.C.

[73] Assignee: Container Corporation of America, Chicago, Ill.

[21] Appl. No.: 283,432

[22] Filed: Jul. 15, 1981

[51] Int. Cl.[3] ..... B65D 5/50

[52] U.S. Cl. ..... 206/44 R; 206/45.14; 206/564; 229/31 FS

[58] Field of Search ..... 206/44 R, 45.12, 45.28, 206/45.29, 45.3, 486, 462, 487, 488, 489, 490, 45.14, 564; 229/39 R, 44 R, 36, 33, 34 R, 34 HW, 15, 29 B, 29 C, 29 D, 29 F, 31 FS

[56] References Cited

U.S. PATENT DOCUMENTS

| | | | |
|---|---|---|---|
| 2,465,169 | 3/1949 | O'Connor | 206/45.14 |
| 2,723,074 | 11/1955 | Wagner | 229/41 B |
| 2,733,832 | 2/1956 | Newton | 229/41 B |
| 2,963,212 | 12/1960 | Gastright | 229/41 B |
| 3,178,096 | 4/1965 | Reeves et al. | 229/41 B |
| 3,700,161 | 10/1972 | Bundy | 229/41 C |
| 3,845,898 | 11/1974 | Hackenberg | 229/28 R |
| 3,856,137 | 12/1975 | Brindley | 206/462 |
| 3,927,761 | 12/1975 | Boyle | 206/45.14 |

FOREIGN PATENT DOCUMENTS

| | | | |
|---|---|---|---|
| 2027413 | 2/1980 | United Kingdom | 206/45.12 |

*Primary Examiner*—William Price
*Assistant Examiner*—B. J. Ehrhardt
*Attorney, Agent, or Firm*—Richard W. Carpenter; Davis Chin

[57] ABSTRACT

A collapsible display carton including an integral internal spacer panel for holding packaged articles in spaced relation.

3 Claims, 6 Drawing Figures

DISPLAY CARTON WITH INTERNAL SPACER

BACKGROUND OF THE INVENTION

1. Field of the Invention

This invention relates generally to collapsible folding cartons, and more particularly to a display carton formed of a unitary blank of foldable paperboard, which is adapted to hold a plurality of a packaged articles, such as carded packages, and to maintain them in spaced relation with each other within the carton.

2. Description of the Prior Art

A start of the art search directed to the subject matter of this application uncovered the following U.S. Pat. Nos. 2,723,074; 2,733,832; 2,963,212; 3,178,096; 3,700,161; 3,845,898.

None of the prior art patents uncovered in the search disclosed a collapsible display carton like that of the present invention wherein a spacer panel, which is foldably joined to the bottom wall of the carton, extends into the carton and presents a plurality of slots for holding and maintaining packaged articles in spaced relationship.

SUMMARY OF THE INVENTION

An object of the invention is to provide a new and improved collapsible display container for holding and displaying a plurality of packaged articles such as visual carded packages.

A more specific object of the invention is the provision, in a carton of the type described, of an internal spacer panel which contains a plurality of slots for receiving and engaging portions of the packaged articles to maintain them in spaced relationship and to prevent them from falling down onto the floor of the carton after certain of them have been removed.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
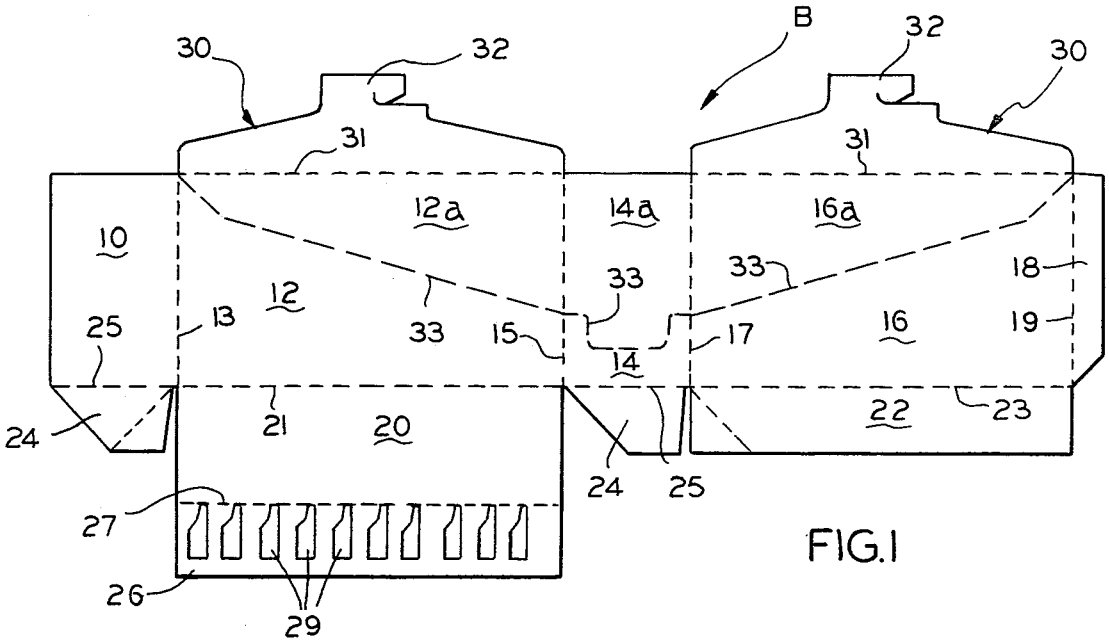
FIG. 1 is a plan view of a blank of foldable sheet material, such as paperboard, from which the structure illustrated in the other views may be formed.
Figure 2:
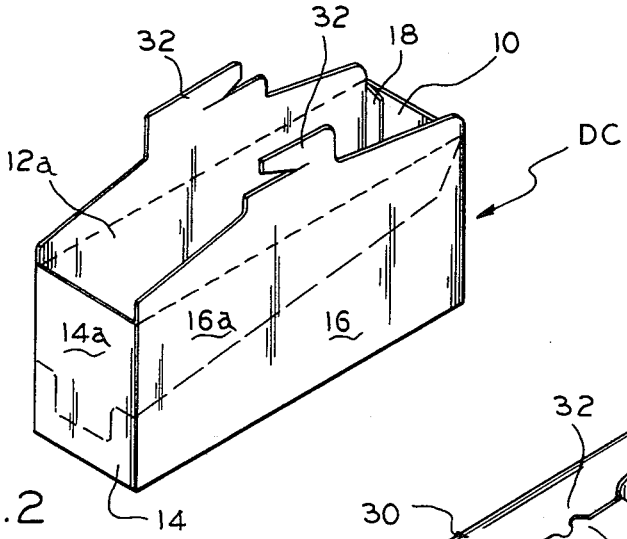
FIG. 2 is a perspective view of a display carton embodying features of the invention, with the upper closure flaps shown in open position.
Figure 5:
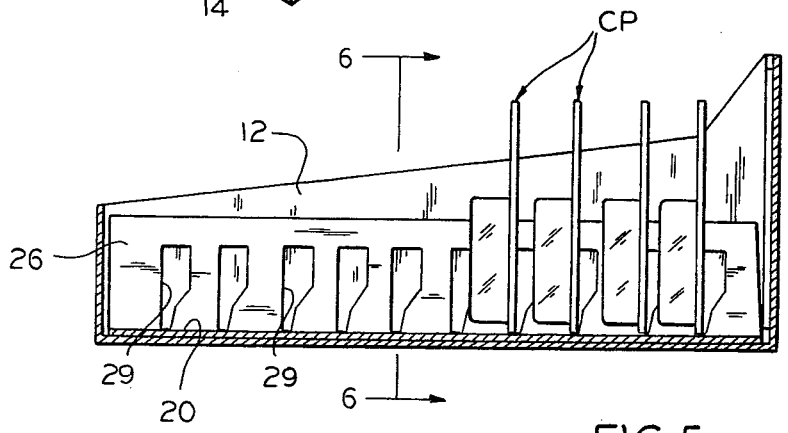
FIG. 5 is a longitudinal vertical section view taken on line 5—5 of FIG. 4.
Figure 6:
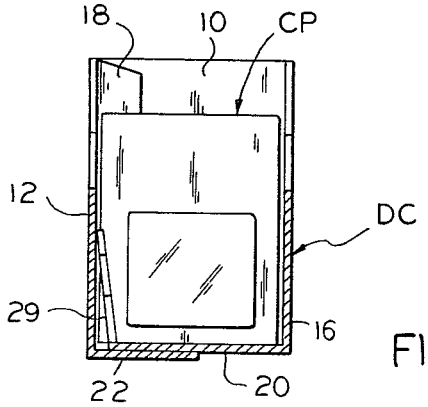
FIG. 6 is a transverse vertical section view taken on line 6—6 of FIG. 5.

Referring now to the drawings for a better understanding of the invention, and particularly to FIGS. 1 and 2, it will be seen that the novel display carton, indicated generally at DC in FIG. 2 may be formed from a unitary blank B of foldable sheet material such as paperboard illustrated in FIG. 1. The carton is adapted to hold a plurality of articles as carded packages indicated generally at CP in FIGS. 4–6.

As best seen in FIG. 1, the body of the carton includes a rear end wall panel 10, a first side wall panel 12, a front end wall panel 14, a second side wall panel 16, and a glue flap 18, all of which are foldably joined to each other along parallel fold lines 13, 15, 17, and 19, respectively.

The carton body comprises a tubular structure which may be closed at the bottom by an automatic bottom wall comprising an inner panel 20, an outer panel 22, and a pair of flaps 24 which are foldably joined to lower edges of first side wall, second side wall, and end walls on fold lines 21, 23, and 25, respectively. Foldably joined to the free edge of inner side panel 20 on fold line 27, is an internal retaining or spacer panel 26 having therein a plurality of spaced apertures 29, the which is described later in the specification.

Figure 3:
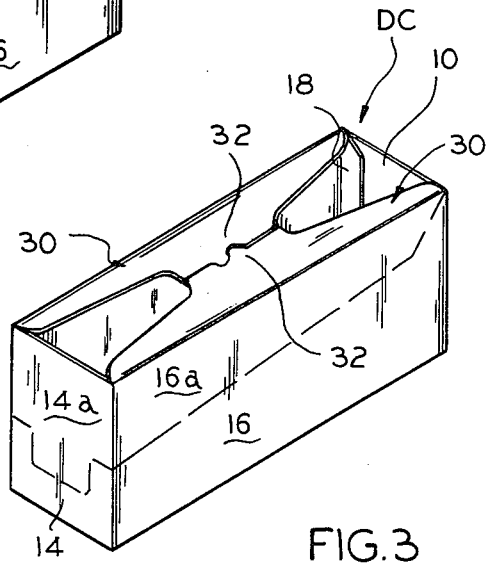
FIG. 3 is a view similar to FIG. 2, but with the upper closure flaps shown in closed position.

The upper portion of the body structure of the carton may be closed by a pair of closure flaps 30 which are foldably joined along fold lines 31 to the upper edges of the side wall panels 12 and 16. Closure flaps 30 may be provided with interlocking tab portions 32 which may be disposed in interlocking engagement with each other, as shown in FIG. 3, when the closure flaps are folded over into overlapping relationship to close the upper end of the carton.

Figure 4:
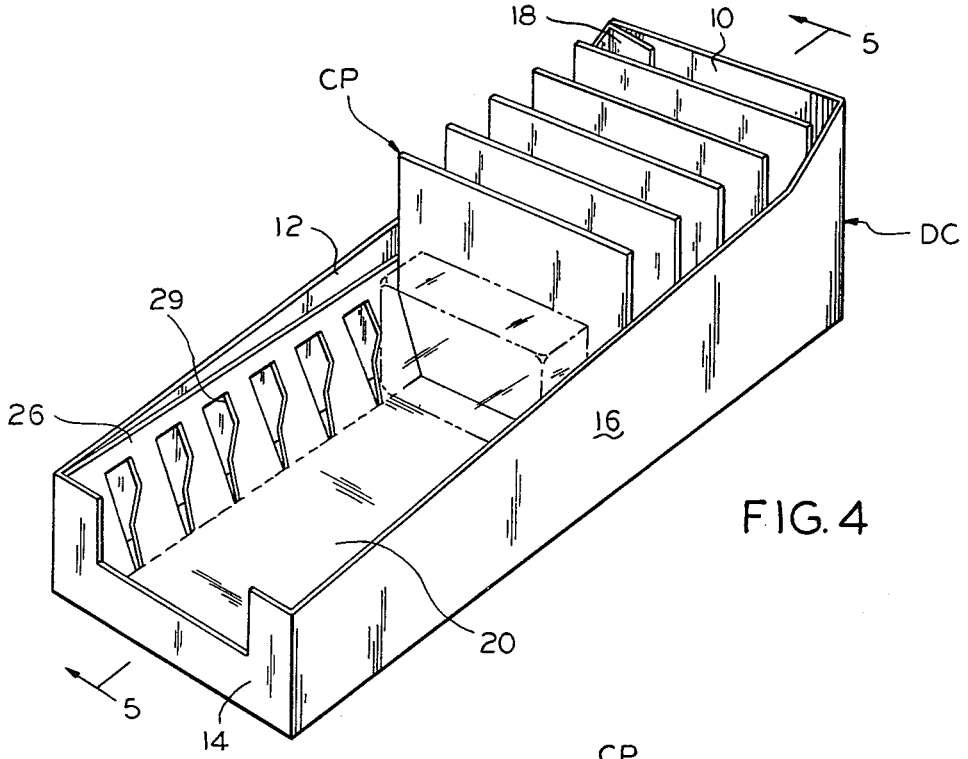
FIG. 4 is a perspective view similar to FIG. 3, but shown after upper portions of the carton have been detached and removed to permit display and sale of the packaged articles.

In order to facilitate the display of packaged articles, first and second side wall panels 12, 16 and front end wall panel 14 have upper portions **12*a*, 16*a*, and 14*a*, respectively, which are joined thereto along a continuous weakened line of tear 33. This permits the upper portions of the side walls and front end walls to be detached and removed from the remaining portion of the carton, together with related closure flaps 30, so that the carton can function as a display carton, as illustrated in FIG. 4**.

The carton is adapted to hold a plurality of articles such as carded packages CP. In order to keep the packaged articles in spaced relation with each other and to prevent them from falling to the floor of the carton when some have been removed, there is provided the spacer panel 26 which extends up into the carton adjacent to one of the side walls and presents a plurality of slots or openings 29 for receiving portions of the packaged articles.

What is claimed is:

1. In a collapsible display carton, formed of a unitary blank of foldable paperboard, for holding and displaying a plurality of articles such as carded packages, the combination comprising of:

(a) a bottom wall including an inner panel and an outer panel;

(b) pairs of opposed side and end walls foldably joined to each other, said side walls having lower edges thereof joined to the inner panel and the other panel of said bottom wall, said side and end walls upstanding from said bottom wall to form a box-like body structure open at the top;

(c) a spacer panel foldably joined to the free edge of the inner panel of said bottom wall, disposed to extend into said body structure inwardly adjacent one of said side walls, and presenting a plurality of spaced apertures for receiving portions of said packaged articles to maintain them in spaced relationship with each other; and (d) certain of said side and end walls having detachable portions which can be removed to afford better viewing of the contents of the carton.

2. A display carton according to claim 1, and including upper closure flaps foldably joined to certain of said walls and adapted to extend across and close the upper end of said body structure.

3. A display carton according to claim 2, wherein certain of said upper closure flaps have means for effecting interlocking engagement with each other.

* * * * *